US010830172B2

(12) United States Patent
Parotto et al.

(10) Patent No.: US 10,830,172 B2
(45) **Date of Patent: *Nov. 10, 2020**

(54) METHOD TO DETERMINE AN OPENING TIME OF AN ELECTROMAGNETIC FUEL INJECTOR

(71) Applicant: MARELLI EUROPE S.p.A., Corbetta (IT)

(72) Inventors: Marco Parotto, Bologna (IT); Marco Morelli, Baschi (IT); Claudio Guido, Bologna (IT); Domenico Paolino, Bologna (IT)

(73) Assignee: MARELLI EUROPE S.p.A., Corbetta (IT)

( * ) Notice: Subject to any disclaimer, the term of this patent is extended or adjusted under 35 U.S.C. 154(b) by 0 days.

This patent is subject to a terminal disclaimer.

(21) Appl. No.: 16/423,906

(22) Filed: May 28, 2019

(65) Prior Publication Data

US 2019/0360423 A1 Nov. 28, 2019

(30) Foreign Application Priority Data

May 28, 2018 (IT) ..... 102018000005765

(51) Int. Cl.
*F02M 51/06* (2006.01)
*F02D 41/30* (2006.01)
*F02D 41/20* (2006.01)

(52) U.S. Cl.
CPC ..... *F02D 41/3082* (2013.01); *F02M 51/0671* (2013.01); *F02D 2041/2055* (2013.01)

(58) Field of Classification Search
CPC ..... F02D 41/3082; F02D 41/2438; F02D 41/2467; F02D 41/20; F02D 2041/2055;
(Continued)

(56) References Cited

U.S. PATENT DOCUMENTS

2006/0224299 A1 10/2006 Cochet et al.
2013/0073188 A1 3/2013 Rosel
(Continued)

FOREIGN PATENT DOCUMENTS

DE 102009045307 A1 4/2011
EP 1619384 A2 1/2006
(Continued)

OTHER PUBLICATIONS

Search Report for Italian Patent Application No. 201800005765 dated Feb. 15, 2019.

*Primary Examiner* — Hai H Huynh
(74) *Attorney, Agent, or Firm* — Howard & Howard Attorneys PLLC

(57) ABSTRACT

Method to determine an opening time of an electromagnetic fuel injector; the electromagnetic fuel injector is controlled using a series of progressively increasing energization times of the electromagnetic actuator; for each control of the electromagnetic injector, the presence or the absence of a closing of the injection valve is detected; the opening time is identified, which is equal to an intermediate value between the last energization time of the electromagnetic actuator for which the absence of a closing of the injection valve was determined and the first energization time of the electromagnetic actuator for which the presence of a closing of the injection valve was determined.

9 Claims, 7 Drawing Sheets

(58) Field of Classification Search
CPC .... F02D 2041/2051; F02D 2041/2058; F02M 51/0671
USPC ..... 123/472, 478, 479, 480, 490; 701/103–105, 107; 73/114.47
See application file for complete search history.

(56) References Cited

U.S. PATENT DOCUMENTS

| | | | | |
|---|---|---|---|---|
| 2013/0104636 | A1 | 5/2013 | Beer et al. | |
| 2019/0360424 | A1* | 11/2019 | Parotto | F02D 41/401 |

FOREIGN PATENT DOCUMENTS

| | | | |
|---|---|---|---|
| EP | 2375036 | A1 | 10/2011 |
| WO | 2016091848 | A1 | 6/2016 |

* cited by examiner

METHOD TO DETERMINE AN OPENING TIME OF AN ELECTROMAGNETIC FUEL INJECTOR

CROSS-REFERENCE TO RELATED APPLICATIONS

This patent application claims priority from Italian Patent Application No. 102018000005765 filed on May 28, 2018, the entire disclosure of which is incorporated herein by reference.

TECHNICAL FIELD

The invention relates to a method to determine an opening time of an electromagnetic fuel injector.

PRIOR ART

An electromagnetic fuel injector (for example like the one described in patent application EP1619384A2) normally comprises a cylindrical, tubular body having a central feeding channel which performs the function of a fuel duct and ends with an injection jet controlled by an injection valve operated by an electromagnetic actuator. The injection valve is provided with a plunger, which is rigidly connected to a movable armature of the electromagnetic actuator so as to moved by the action of the electromagnetic actuator between a closed position and an open position of the injection jet against the action of a closing spring which pushes the plunger towards the closed position. The valve seat is defined in a sealing element, which has the shape of a disc, seals the central channel of the support body on the lower side, and is crossed by the injection jet. The electromagnetic actuator comprises a coil, which is arranged on the outside around the tubular body, and a fixed magnetic pole, which is made of a ferromagnetic material and is arranged inside the tubular body so as to magnetically attract the movable armature.

The injection valve is normally closed due to the closing spring pushing the plunger to the closing position, in which the plunger presses against a valve seat of the injection valve and the movable armature is spaced apart from the fixed magnetic pole. In order to open the injection valve, i.e. move the plunger from the closing position to the opening position, the coil of the electromagnetic actuator is energized so as to generate a magnetic field which attracts the movable armature towards the fixed magnetic pole against the elastic force exerted by the closing spring; in the opening phase, the travel of the movable armature stops when the movable armature hits the fixed magnetic pole.

According to FIG. 3, the law of injection (i.e. the law linking the injection time $T_{INJ}$, or control time, to the injected fuel quantity Q and represented by the injection time $T_{INJ}$—injected fuel quantity Q curve) of an electromagnetic injector can be divided into three areas: an initial area A of failed opening, in which the injection time $T_{INJ}$ is too small and, hence, the energy delivered to the coil of the electromagnet is not sufficient to overcome the force of the closing spring and the plunger remains still in the closed position of the injection jet; a ballistic area B, in which the plunger moves from the closed position of the injection jet towards a complete open position (in which the movable armature, which is integral to the plunger, strikes against the fixed magnetic pole), but cannot reach the complete open position and, hence, returns to the closed position before having reached the complete open position; and a linear area C, in which the plunger moves from the closed position of the injection jet to the complete open position, which is maintained for a given amount of time.

The opening time of an electromagnetic injector is the time elapsing between the instant in which the energization of the electromagnetic actuator starts and the instant in which the injection valve actually starts opening; in the law of injection (shown in FIG. 3), the opening time $T_O$ establishes the boundary between the initial area A of failed opening and the ballistic operating area B: indeed, if the injection (control) time $T_{INJ}$ is smaller than the opening time $T_O$, the injection valve does not open and, hence, we are in the initial area A of failed opening, whereas, if the injection (control) time is greater than the opening time $T_O$, the injection valve opens and, hence, we are in the ballistic operating area B (or, if the injection time $T_{INJ}$ is long enough, we are in the linear area C).

Precisely knowing the opening time of an electromagnetic injector leads to better knowing the law of injection and, hence, allows for more precise fuel injections (especially when small quantities of fuel must be injected, thus causing the electromagnetic injector to operate in the ballistic operating area B).

Patent application WO2016091848A1 discloses a method to determine an opening time of an electromagnetic fuel injector: the electromagnetic fuel injector is controlled using a series of progressively increasing energization times of the electromagnetic actuator; for each control of the electromagnetic injector, the presence or the absence of a closing of the injection valve is detected; the opening time is identified, which is equal to an intermediate value between the last energization time of the electromagnetic actuator for which the absence of a closing of the injection valve was determined and the first energization time of the electromagnetic actuator for which the presence of a closing of the injection valve was determined.

DESCRIPTION OF THE INVENTION

The object of the invention is to provide a method to determine an opening time of an electromagnetic fuel injector, said method being capable of determining the opening time with a great precision and, in particular, being easy and economic to be implemented.

According to the invention, there is provided a method to determine an opening time of an electromagnetic fuel injector according to the appended claims.

The appended claims describe preferred embodiments of the invention and form an integral part of the description.

BRIEF DESCRIPTION OF THE DRAWINGS

The invention will now be described with reference to the accompanying drawings, showing a non-limiting embodiment thereof, wherein.

PREFERRED EMBODIMENTS OF THE INVENTION

Figure 1:
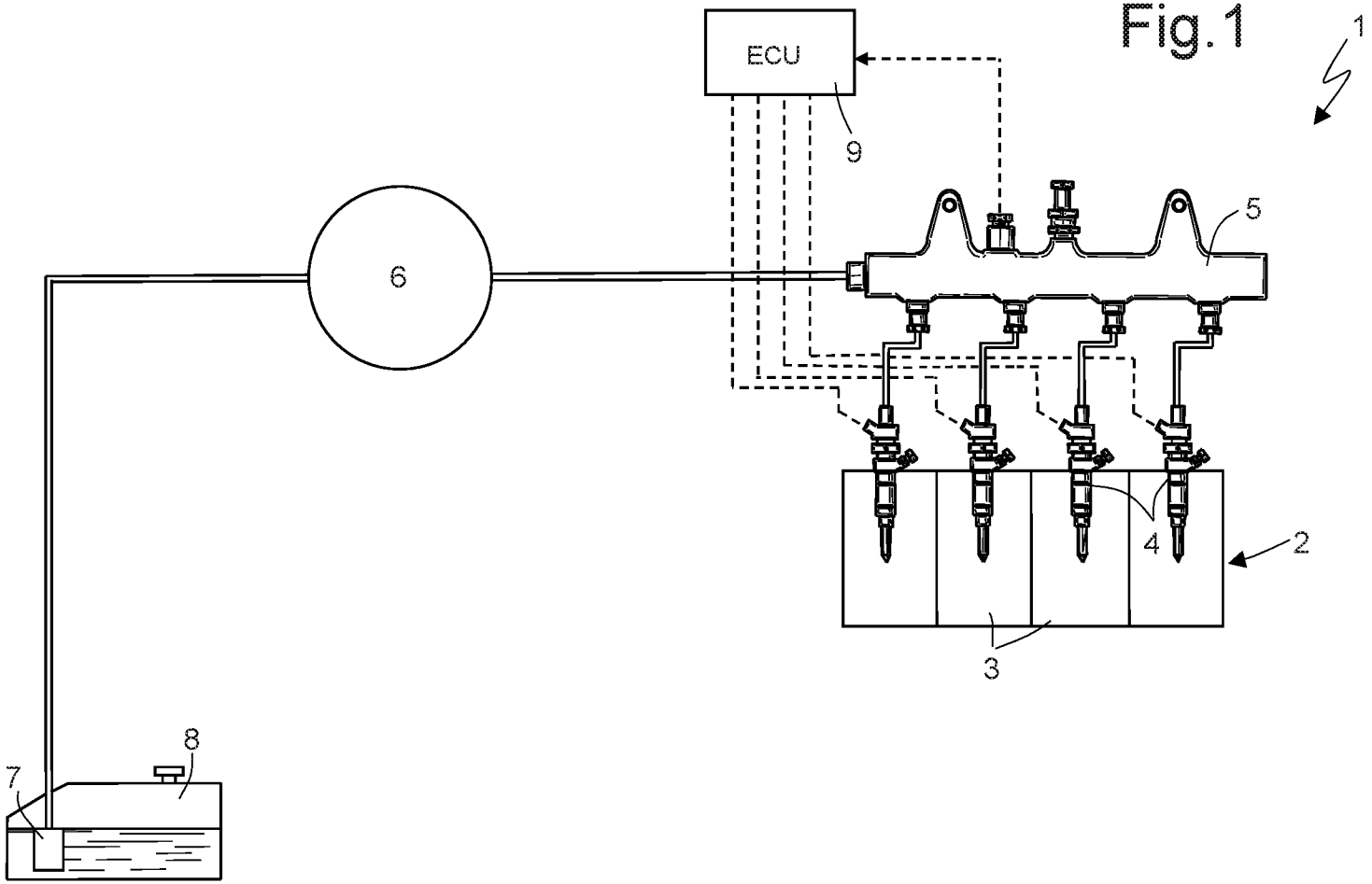
FIG. 1 is a schematic view of a common-rail injection system implementing the method according to the invention.

In FIG. 1, number 1 indicates, as a whole, a common-rail injection system for the direct injection of fuel in an internal combustion engine 2 provided with four cylinders 3. The injection system 1 comprises four electromagnetic fuel injectors 4, each injecting the fuel directly into a respective cylinder 3 of the engine 2 and receiving the fuel under pressure from a common-rail 5. The injection system 1 comprises a high-pressure pump 6, which feeds the fuel to the common-rail 5 and is directly operated by a drive shaft of the engine 2 by means of a mechanical transmission with a frequency of actuation that is directly proportional to the speed of rotation of the drive shaft. In turn, the high-pressure pump 6 is supplied by a low-pressure pump 7 arranged inside a fuel tank 8. Each electromagnetic injector 4 injects a variable quantity of fuel into the corresponding cylinder 3 under the control of an electronic control unit 9.

Figure 2:
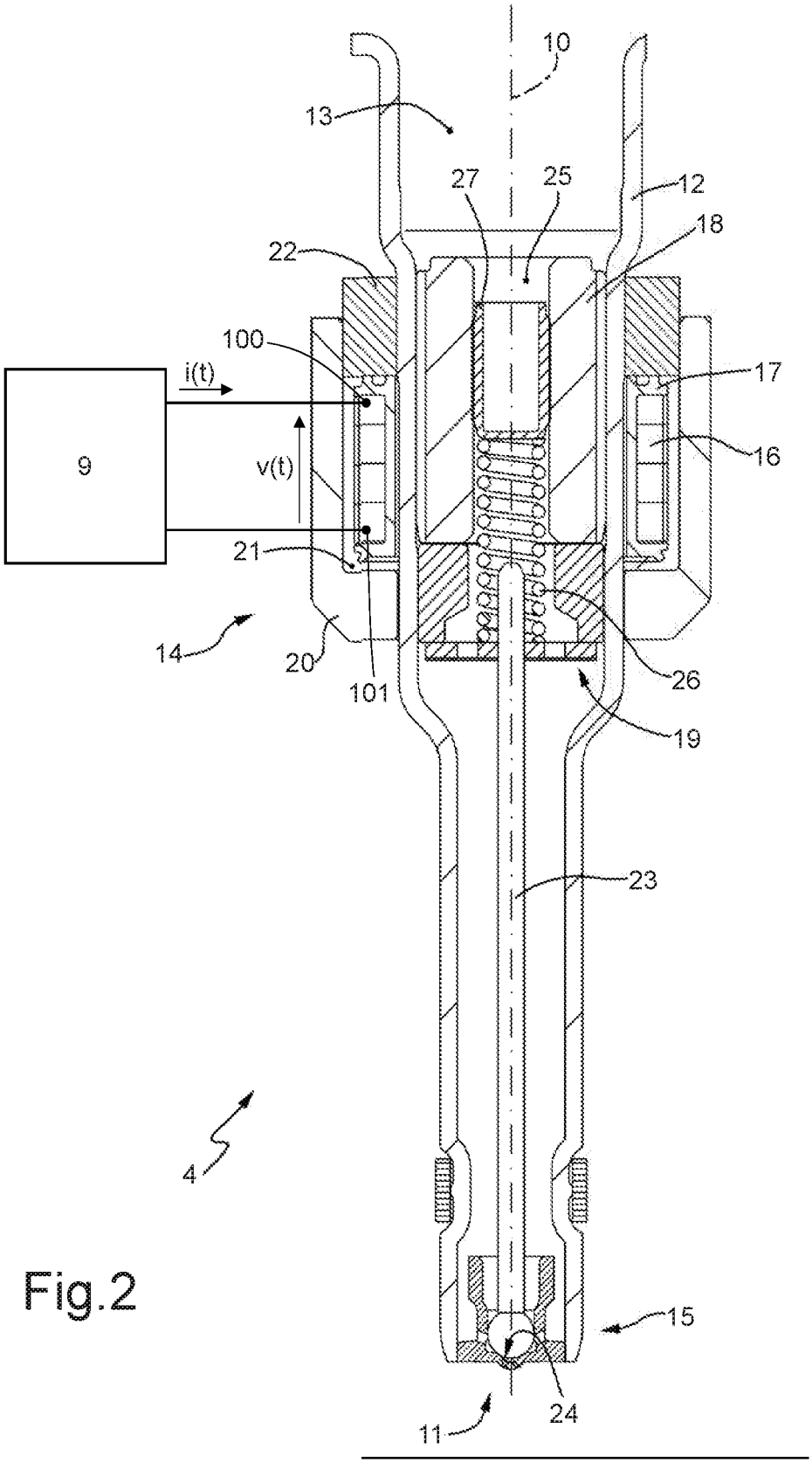
FIG. 2 is a schematic, sectional, side elevation view of an electromagnetic fuel injector of the injection system of FIG. 1.

According to FIG. 2, each electromagnetic fuel injector 4 substantially has a cylindrical symmetry around a longitudinal axis 10 and is controlled so as to inject fuel from an injection nozzle 11. The electromagnetic injector 4 comprises a support body 12, which has a cylindrical tubular shape with a variable cross-section along the longitudinal axis 10 and comprises a feeding channel 13 extending along the entire length of the support body 12 so as to feed the fuel under pressure to the injection nozzle 11. The support body 12 supports, in the area of an upper portion of its, an electromagnetic actuator 14 and, in the area of a lower portion of its, an injection valve 15, which delimits the feeding channel 13 at the bottom; in use, the injection valve 15 is operated by the electromagnetic actuator 14 so as to adjust the flow of fuel through the injection jet 11, which is obtained in the area of the injection valve 15.

The electromagnetic actuator 14 comprises a coil 16, which is arranged on the outside around the tubular body 12 and is enclosed in a toroidal casing 17 made of a plastic material, and a fixed magnetic pole 18, which is made of a ferromagnetic material and is arranged inside the tubular body 12 in the area of the coil 16. Furthermore, the electromagnetic actuator 15 comprises a movable armature 19, which has a cylindrical shape, is made of a ferromagnetic material and is designed to be magnetically attracted by the magnetic pole 18 when the coil 16 is energized (i.e. a current flows through it). Finally, the electromagnetic actuator 15 comprises a tubular magnetic armature 20, which is made of a ferromagnetic material, is arranged on the outside of the tubular body 12 and comprises an annular seat 21 to house, on the inside, the coil 16, and a magnetic washer 22 with an annular shape, which is made of a ferromagnetic material and is arranged above the coil 16 to guide the closing of the magnetic flux around the coil 16.

The movable armature 19 is part of a movable equipment, which comprises, furthermore, a shutter or plunger 23 having an upper portion integral to the movable armature 19 and a lower portion cooperating with a valve seat 24) of the injection valve 15 so as to adjust, in a known manner, the flow of fuel towards the injection nozzle 11. In particular, the plunger 23 ends with a shutting head with a substantially spherical shape, which is designed to rest against the valve seat in a sealing manner.

The magnetic pole 18 is perforated at the centre and has a central through hole 25, which partially houses a closing spring 26, which pushes the movable armature 19 towards a closed position of the injection valve 15. In particular, inside the central hole 25 of the magnetic pole 18 there is fitted, in a fixed position, a striker element 27, which keeps the closing spring 26 compressed against the movable armature 19.

In use, when the electromagnetic actuator 14 is de-energized, the movable armature 19 is not attracted by the magnetic pole 18 and the elastic force of the closing spring 26 pushes the movable armature 19 together with the plunger 23 (i.e. the movable equipment) downwards up to a lower limit position, in which the shutting head of the plunger 23 is pressed against the valve seat 24 of the injection valve 15 insulating the injection nozzle 11 from the fuel under pressure. When the electromagnetic actuator 14 is energized, the movable armature 19 is magnetically attracted by the magnetic pole 18 against the elastic force of the closing spring 26 and the movable armature 19 together with the plunger 23 (i.e. the movable equipment) move upwards, due to the magnetic attraction exerted by the magnetic pole 18, up to the an upper limit position, in which the movable armature 19 strikes against the magnetic pole 18 and the shutting head of the plunger 23 is lifted relative to the valve seat 24 of the injection valve 15 allowing the fuel under pressure to flow through the injection nozzle 11.

According to FIG. 2, the coil 16 of the electromagnetic actuator 14 of each electromagnetic fuel injector 4 is powered by the electronic control unit 9, which applies, to the terminals 100 and 101 (namely to the ends) of the coil 16, a voltage v, which is variable in time and determines the circulation, through the coil 16, of a current i, which is variable in time. The terminal 100 of the coil 16 is the high-voltage terminal and can be connected to the power supply voltage through at least one first control transistor of the electronic control unit 9; on the other hand, the terminal 101 of the coil 16 is the low-voltage terminal and can be connected to the electric ground through at least one second control transistor of the electronic control unit 9.

Figure 3:
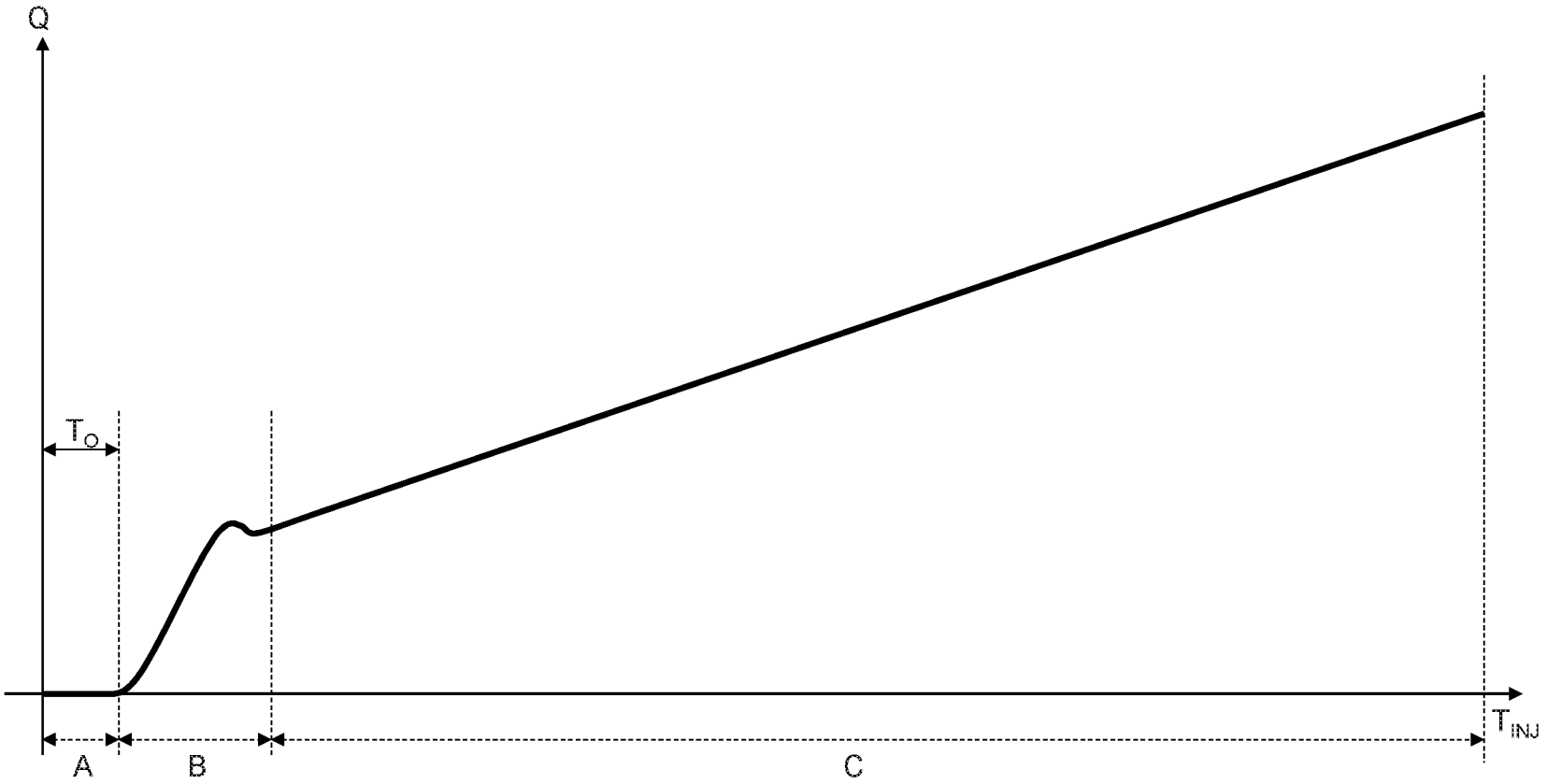
FIG. 3 is diagram showing the injection feature of an electromagnetic fuel injector of the injection system of FIG. 1.

According to FIG. 3, the law of injection (i.e. the law linking the injection time $T_{INJ}$, or control time, to the injected fuel quantity Q and represented by the injection time $T_{INJ}$—injected fuel quantity Q curve) of each electromagnetic fuel injector 4 can be divided into three areas: an initial area A of failed opening, in which the injection time $T_{INJ}$ is too small and, hence, the energy delivered to the coil 16 of the electromagnetic actuator 14 produces a force that is not sufficient to overcome the force of the closing spring 26 and the plunger 23 remains still in the closed position of the injection valve 15; a ballistic area B, in which the plunger 23 moves from the closed position of the injection valve 15 towards a complete open position (in which the movable armature 19, which is integral to the plunger 23, strikes against the fixed magnetic pole 18), but cannot reach the complete open position and, hence, returns to the closed position before having reached the complete open position; and a linear area C, in which the plunger 23 moves from the closed position of the injection valve 15 to the complete open position, which is maintained for a given amount of time.

Figure 4:
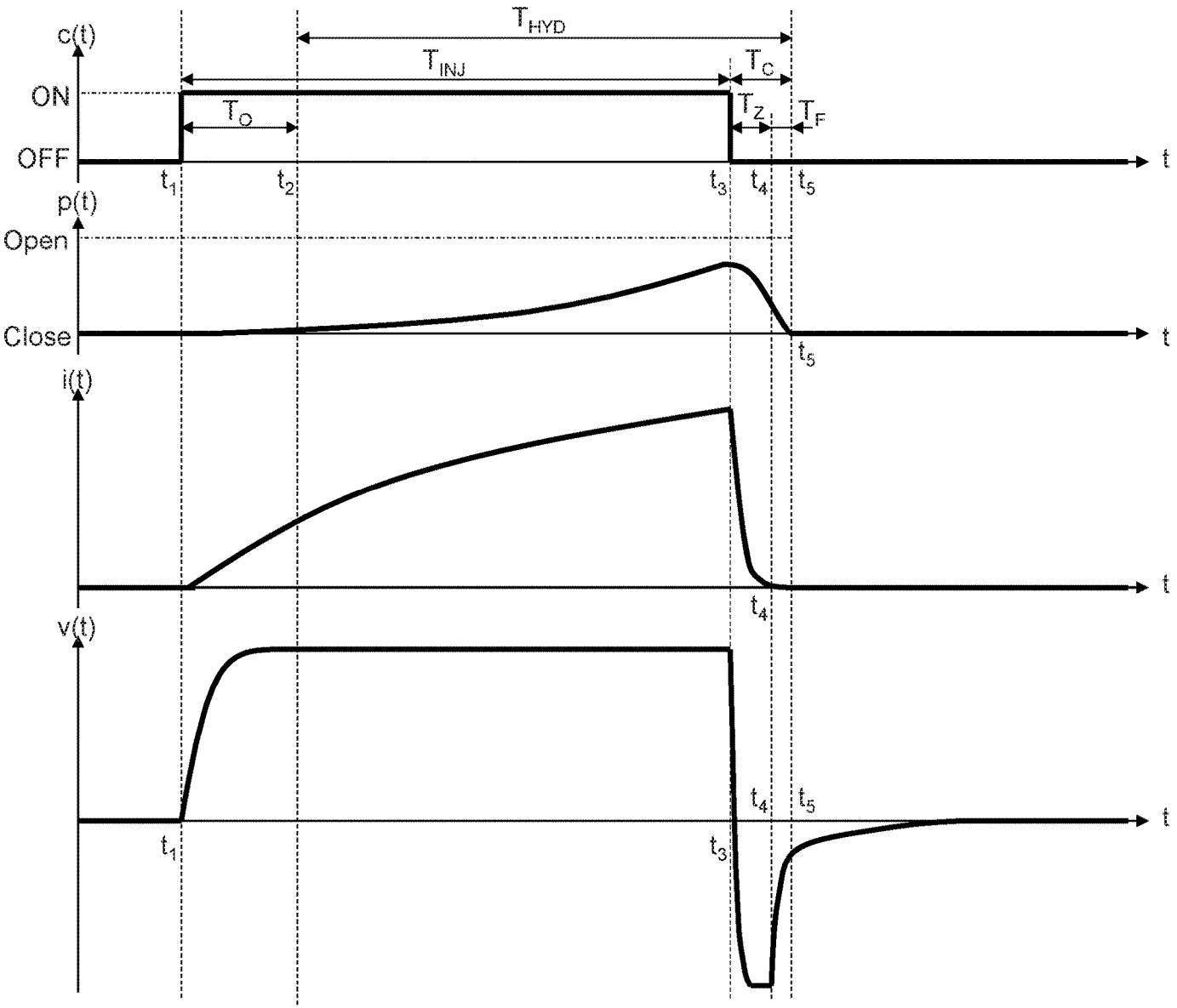
FIG. 4 is a diagram showing the evolution over time of some physical quantities of an electromagnetic fuel injector of the injection system of FIG. 1, which is controlled so as to inject fuel in a ballistic operating area.

The diagram of FIG. 4 shows the evolution over time of some physical quantities of an electromagnetic fuel injector 4, which is controlled so as to inject fuel in the ballistic operating area B. In other words, the injection time $T_{INJ}$ is reduced (by approximately 0.15-0.30 ms depending on the pressure of the fuel and on the type of injector) and, hence, due the electromagnetic attraction generated by the electromagnetic actuator 14, the plunger 23 (together with the movable armature 19) moves from the closed position of the injection valve 15 towards a complete open position (in which the movable armature 19, which is integral to the plunger 23, strikes against the fixed magnetic pole 18), which, though, is not reached, as the electromagnetic actuator 14 is turned off before the plunger 23 (together with the movable armature 19) can reach the complete open position of the injection valve 15; as a consequence, when the plunger 23 is still "flying" (i.e. is in an intermediate position between the closed position and the complete open position of the injection valve 15) and is moving towards the complete open position, the electromagnetic actuator 14 is turned off and the thrust generated by the closing spring 26 interrupts the movement of the plunger 23 towards the complete open position of the injection valve 15, thus moving the plunger 23 in an opposite direction until the plunger 23 reaches the initial closed position of the injection valve 15.

According to FIG. 4, the logic control command c of the electromagnetic injector 4 involves activating (energizing) the electromagnetic actuator 14 in an instant $t_1$ (shifting of the logic control command c from the OFF state to the ON state) and deactivating (de-energizing) the electromagnetic actuator 14 in an instant $t_3$ (shifting of the logic control command from the ON state to the OFF state). The injection time $T_{INJ}$ is equal to the time interval elapsing between the instants $t_1$ and $t_3$ and is small; as a consequence, the electromagnetic fuel injector 4 operates in the ballistic operating area B.

In the instant $t_1$, the coil 16 of the electromagnetic actuator 14 is energized and, hence, starts producing a drive force, which counters the force of the closing spring 26; when the drive force generated by the coil 16 of the electromagnetic actuator 14 exceeds the force of the closing spring 26, namely in the instant $t_2$, the position p of the plunger 23 (which is integral to the movable armature 19) starts changing from the closed position of the injection valve 15 (indicated with "Close" in FIG. 4) to the complete open position of the injection valve 15 (indicated with "Open" in FIG. 4); in other words, the injection valve 15 starts opening in the instant $t_2$ and the time elapsing between the instants $t_1$ and $t_2$ defines the opening time $T_O$ (namely, the time elapsing between the instant $t_1$ in which the energization of the electromagnetic actuator 14 starts and the instant $t_2$ in which the injection valve 15 actually starts opening). In the law of injection (shown in FIG. 3), the opening time $T_O$ establishes the boundary between the initial area A of failed opening and the ballistic operating area B: indeed, if the injection time $T_{INJ}$ is smaller than the opening time $T_O$, the injection valve 15 does not open and, hence, we are in the initial area A of failed opening, whereas, if the injection time $T_{INJ}$ is greater than the opening time $T_O$, the injection valve 15 opens and, hence, we are in the ballistic operating area B (or, if the injection time $T_{INJ}$ is long enough, we are in the linear area C).

In the instant $t_3$, the position p of the plunger 23 still has not reached the complete open position of the injection valve 15 and, due to the end of the logic control command c of the electromagnetic injector 4, it goes back to the closed position of the injection valve 15, which is reached in the instant $t_5$ (i.e. in the moment in which the shutting head of the plunger 23 rests against the valve seat of the injection valve 15 is a sealing manner). Before the instant $t_5$ (i.e. the moment in which the injection valve 15 is closed), the instant $t_4$ is identified, in which the current i flowing through the coil 16 is cancelled (namely, reaches a zero value) and in which the voltage v applied to the ends of the coil 16 starts decreasing (in absolute value), moving towards a zero value. The closing time $T_C$ is the time interval elapsing between the instants $t_3$ and $t_5$, i.e. the time interval elapsing between the end of the logic control command c of the electromagnetic injector 4 and the closing of the electromagnetic injector 4. The closing time $T_C$ is also equal to the sum of a zeroing time $T_Z$, which is comprised between the instants $t_3$ and $t_4$ and in which the current i flowing through the coil 16 is still present (and, hence, the electromagnetic actuator 14 still produces a magnetic attraction force for the movable armature 19), and a flying time $T_F$, which is comprised between the instants $t_4$ and $t_5$ and in which the current i flowing through the coil is equal to zero and, hence, the sole elastic force generated by the closing spring 26 acts upon the movable armature 19.

In the instant $t_1$, the voltage v applied to the ends of the coil 16 of the electromagnetic actuator 14 of the electromagnetic injector 4 is caused to increase until it reaches a positive turning-on peak, which serves the purpose of quickly increasing the current i flowing through the coil 16; at the end of the turning-on peak, the voltage v applied to the ends of the coil 16 is controlled according to the "chopper" technique, which involves cyclically changing the voltage v between a positive value and a zero value so as to keep the current i in the neighbourhood of a desired maintaining value (for the sake of simplicity, the cyclic change in the voltage v is not shown in FIG. 4). In the instant $t_3$, the voltage v applied to the ends of the coil 16 is caused to quickly decrease until it reaches a negative turning-off peak, which serves the purpose of quickly cancelling the current i flowing through the coil 16. Once the current i has reached a zero value in the instant $t_4$, the residual voltage v runs down with an exponential law until it is cancelled and, during this voltage v cancellation step, the electromagnetic injector 4 closes (in the instant $t_4$, in which the plunger 23 reaches the closed position of the injection valve 15); indeed, the plunger 23 starts the closing travel towards the closed position of the injection valve 15 only when the force of the closing spring 26 exceeds the electromagnetic attraction force which is generated by the electromagnetic actuator 14 and is proportional to the current i (i.e. becomes equal to zero when the current i reaches a zero value).

Figure 5:
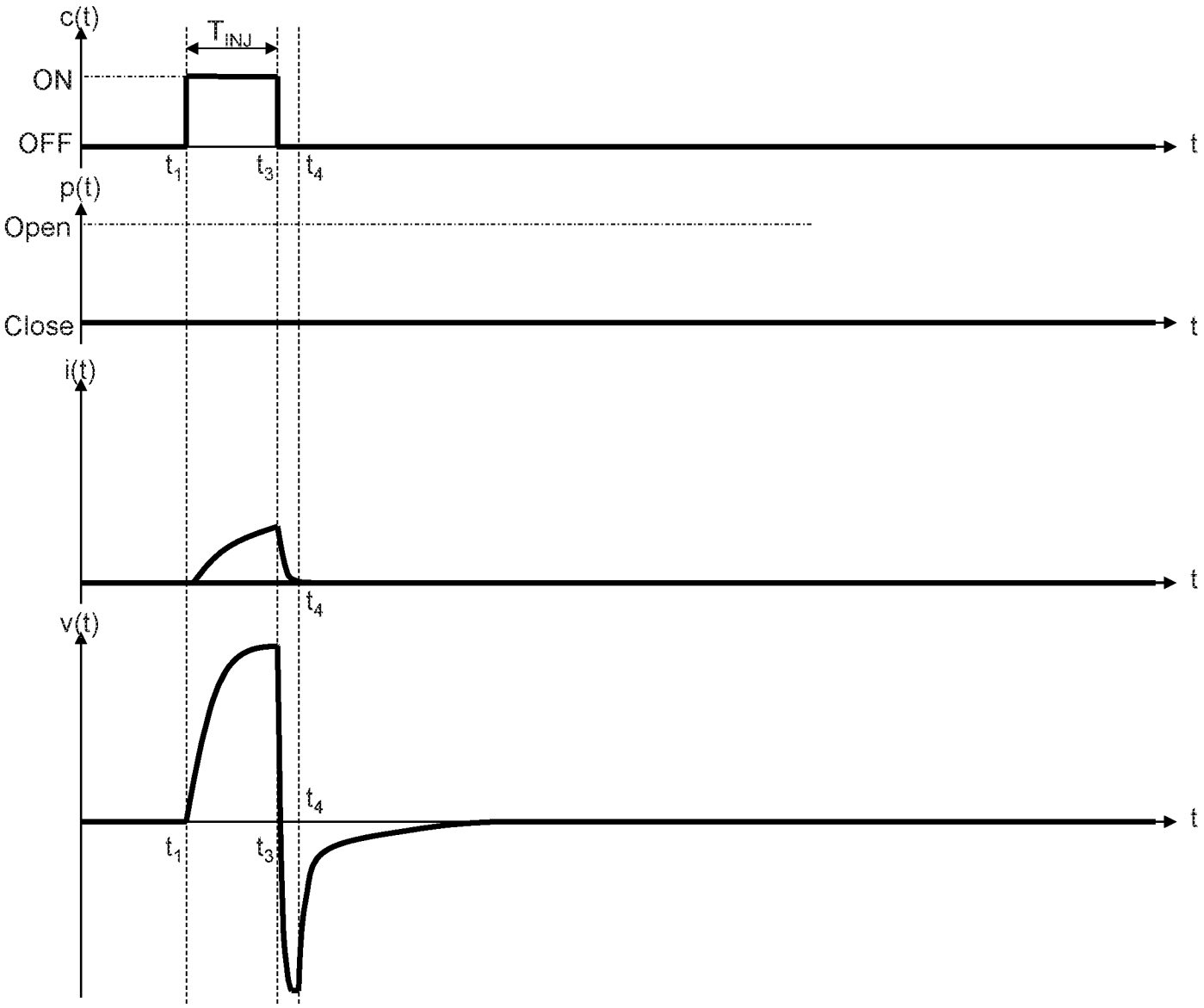
FIG. 5 is a diagram showing the evolution over time of some physical quantities of an electromagnetic fuel injector of the injection system of FIG. 1, which is controlled for such a short amount of time that the injection of fuel is avoided.

The diagram of FIG. 5 shows the evolution over time of some physical quantities of an electromagnetic fuel injector 4, which is controlled with an injection time $T_{INJ}$ (which, in turn, is equal to the time interval elapsing between the beginning instant $t_1$ of the injection and the end instant $t_3$ of the injection) that is so small that it cannot reach the opening of the injection valve 15 (namely, an injection time $T_{INJ}$ which belongs the initial area A of failed opening and is smaller than the opening time $T_O$). In other words, the injection time $T_{INJ}$ is smaller than the opening time $T_O$ and, hence, is so small (around 0.05-0.15 ms) that the electromagnetic attraction generated by the electromagnetic actuator 14 upon the plunger 23 (together with the movable armature 19) always remains smaller than the elastic force generated by the closing spring 26.

According to FIG. 5, the logic control command c of the electromagnetic injector 4 involves activating (energizing) the electromagnetic actuator 14 in an instant $t_1$ (shifting of the logic control command c from the OFF state to the ON state) and deactivating (de-energizing) the electromagnetic actuator 14 in an instant $t_3$ (shifting of the logic control command from the ON state to the OFF state). The injection time $T_{INJ}$ is equal to the time interval elapsing between the instants $t_1$ and $t_3$ and is small; as a consequence, the electromagnetic fuel injector 4 operates in the initial area A of failed opening.

In the instant $t_1$, the coil 16 of the electromagnetic actuator 14 is energized and, hence, starts producing a drive force, which counters the force of the closing spring 26; however, the drive force generated by the electromagnetic actuator 14 never manages to overcome (exceed) the elastic force generated by the closing spring 26 and, therefore, the plunger 23 (which is integral to the movable armature 19) never moves from the closed position of the injection valve 15 (indicated with "Close" in FIG. 5). In the instant $t_4$, the current i flowing through the coil 16 is cancelled (namely, reaches a zero value) and the voltage v applied to the ends of the coil 16 starts decreasing (in absolute value), approaching a zero value. Once the current i has reached a zero value in the instant $t_4$, the residual voltage v runs down with an exponential law until it is cancelled.

Hereinafter is a description of the procedure used by the electronic control unit 9 to determine the closing instant $t_5$ of the electromagnetic fuel injector 4 (namely, to determine the closing time $T_C$, which corresponds to the time interval elapsing between the instants $t_3$ and $t_5$, namely the time interval elapsing between the end of the logic control command c of the electromagnetic injector 4 and the closing of the electromagnetic injector 4).

As already mentioned above when discussing FIG. 4, in the beginning instant $t_1$ of the injection, the electronic control unit 9 applies, to the coil 16 of the electromagnetic actuator 14, a positive voltage v so as to cause an actuation electric current i to circulate through the coil 16, said actuation electric current i determining the opening of the injection valve 15, and, in the end instant $t_3$ of the injection, the electronic control unit 9 applies, to the coil 16 of the electromagnetic actuator 14, a negative voltage v to cancel (in the instant $t_4$) the actuation electric current i circulating through the coil 16.

Figure 6:
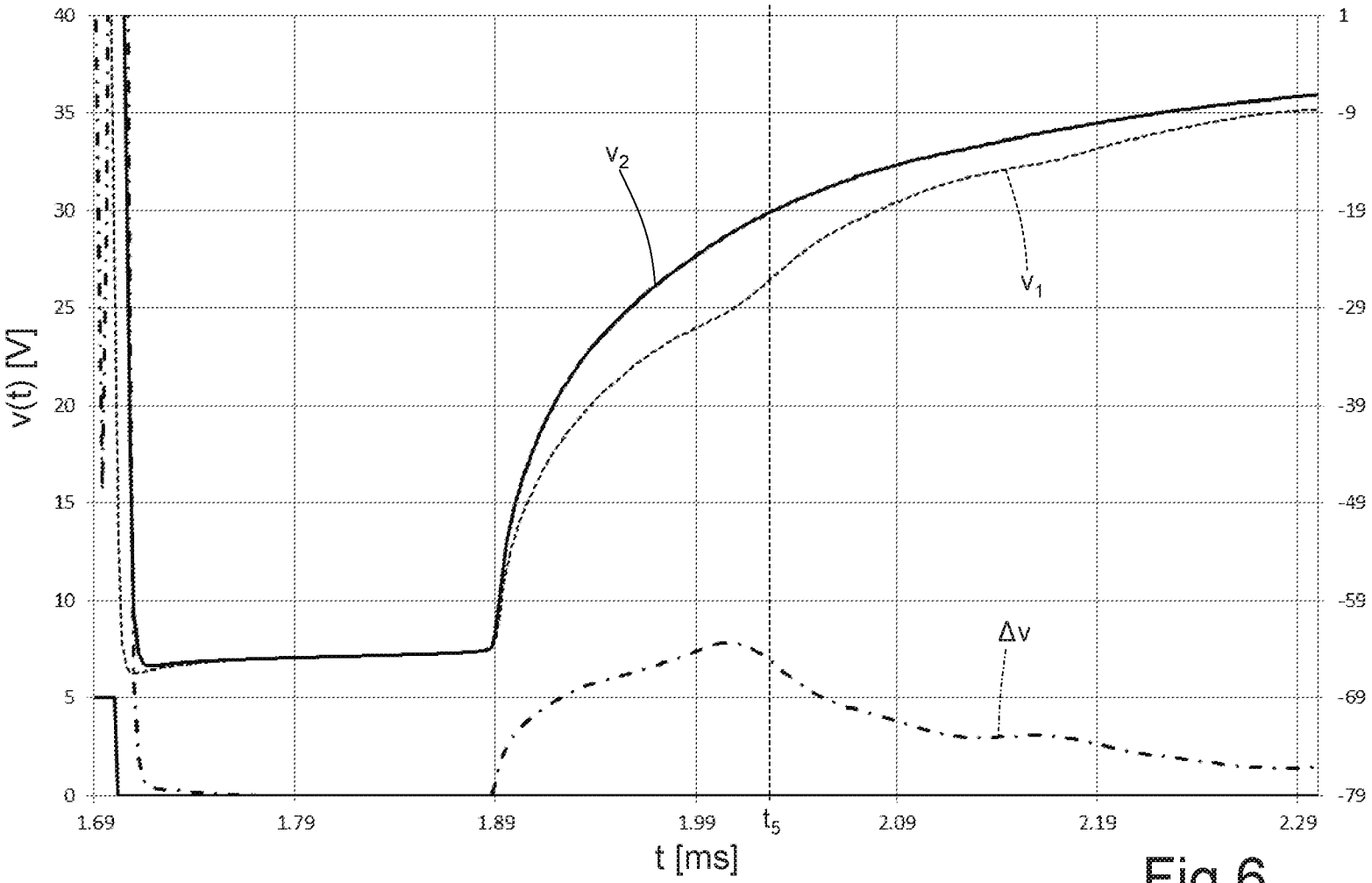
FIG. 6 is a diagram showing the evolution over time: of the electrical voltage at the ends of a coil of an electromagnetic fuel injector of the injection system of FIG. 1, of a corresponding reference electrical voltage, and of their difference.

At the end of the injection (i.e. after the end instant $t_3$ of the injection), the electronic control unit 9 detects (measures) a voltage actuation time development $v_1$ (shown in FIG. 6) at at least one end (i.e. one terminal 100 or 101) of the coil 16 of the electromagnetic actuator 14 after the cancellation of the actuation electric current i circulating through the coil 16 (i.e. after the instant $t_4$) and until the cancellation of the voltage v. Subsequently, the electronic control unit 9 compares the voltage actuation time development $v_1$ with a voltage comparison time development $v_2$ previously determined in the ways described below. Finally, the electronic control unit 9 determines the closing instant $t_5$ of the electromagnetic fuel injector 4 based on the comparison between the voltage actuation time development $v_1$ and the voltage comparison time development $v_2$.

In order to determine the voltage comparison time development $v_2$, the electronic control unit 9 carries out beforehand, namely before determining the closing instant $t_5$ of the electromagnetic injector 4, a test on the electromagnetic injector 4, which is controlled with an injection time $T_{INJ}$ (which, in turn, is equal to the time interval elapsing between the beginning instant $t_1$ of the injection and the end instant $t_3$ of the injection) that is so small that it cannot reach the opening of the injection valve 15 (namely, an injection time $T_{INJ}$ which belongs the initial area A of failed opening and is smaller than the opening time $T_O$), as shown in FIG. 5. In other words, the electronic control unit 9 applies, in a beginning instant $t_1$ of the test, a positive voltage v to the coil 16 of the electromagnetic actuator 14 so as to cause a test electric current i to circulate through the coil 16, said test electric current i not determining the opening of the injection valve 15, and the electronic control unit 9 applies, in an end instant $t_3$ of the test, a negative voltage v to the coil 16 of the electromagnetic actuator 14 so as to cancel the test electric current i circulating through the coil 16 without determining the opening of the injection valve 15. Finally, the electronic control unit 9 detects (measures) a voltage comparison time development $v_2$ (shown in FIG. 6) at at least one end (namely, one terminal 100 or 101) of the coil 16 of the electromagnetic actuator 14 after the cancellation of the test electric current i circulating through the coil 16 without determining the opening of the injection valve 15; in other words, the electronic control unit 9 identifies the voltage comparison time development $v_2$ as time development after the cancellation of the test electric current i circulating through the coil 16 without determining the opening of the injection valve 15.

According to a possible, tough non-binding embodiment, the electronic control unit 9 is provided with a hardware anti-aliasing filter (namely, a physical anti-aliasing filter acting upon the analogue signal before the digitization), which acts upon the measurement of the voltage v at at least one end (namely, one terminal 100 or 101) of the coil 16 of the electromagnetic actuator 14. The anti-aliasing filter is an analogue signal used before the sampling of the signal of the voltage v, so as to narrow the band of the signal in order to approximately fulfil the Nyquist-Shannon sampling theorem.

When the shutting head of the plunger 23 hits the valve seat of the injection valve 15 (i.e. when the electromagnetic injector 4 closes), the movable armature 19, which is integral to the plunger 23, very quickly changes its law of motion (i.e. it almost instantly shifts from a relatively high speed to a zero speed and, if necessary, it could even make a small bounce which reverses the speed direction) and this basically instantaneous change in the law of motion of the movable armature 19 produces a perturbation in the magnetic field linked to the coil 16 and, hence, also determines a perturbation of the voltage v at the ends of the coil 16.

As a consequence, there is a (detectable) difference between the voltage actuation time development $v_1$, which involves a closing of the injection valve 15 at the end of the movement of the plunger 23, and the voltage comparison time development $v_2$, which does not involve a closing of the injection valve 15, as the plunger 23 does not move; this difference is due to the fact that in the voltage actuation time development $v_1$, which involves a closing of the injection valve 15 at the end of the movement of the plunger 23, there is a perturbation due to the impact of the plunger 23 against the valve seat of the injection valve 15, whereas in the voltage comparison time development $v_2$, which does not involve a closing of the injection valve 15, as the plunger 23 does not move, there is no perturbation due to the impact of the plunger 23 against the valve seat of the injection valve 15. By searching for this perturbation (due to the impact of the plunger 23 against the valve seat of the injection valve 15) in the comparison between the voltage actuation time development $v_1$, which involves a closing of the injection valve 15 at the end of the movement of the plunger 23, and the voltage comparison time development v2, which does not involve a closing of the injection valve 15, as the plunger 23 does not move, it is possible to determine the closing instant $t_5$ of the electromagnetic injector 4.

According to a preferred embodiment, the electronic control unit 9 synchronizes the voltage actuation time development $v_1$ with the voltage comparison time development $v_2$ by aligning, in a time-wise manner, a first instant $t_4$ in which the actuation electric current i circulating through the coil 16 is cancelled with a second instant $t_4$ in which the test electric current i circulating through the coil 16 is cancelled.

According to a preferred embodiment, the electronic control unit 9 calculates (by means of a simple subtraction) a voltage difference Δv (shown in FIG. 6) between the voltage actuation time development $v_1$ and the voltage comparison time development $v_2$ and determines the closing instant $t_5$ of the electromagnetic injector 4 based on the voltage difference Δv. The electronic control unit 9 preferably, though not necessarily, applies a low-pass filter, in particular a sliding-window filter, to the voltage difference Δv so as to eliminate the high-frequency noise.

Figure 7:
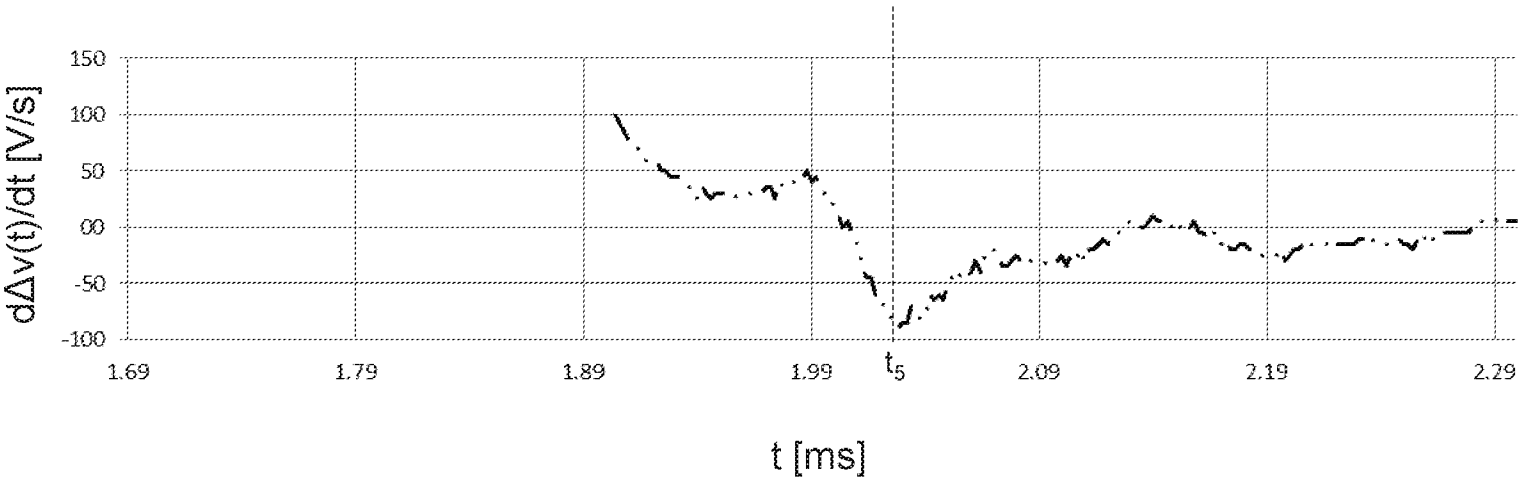
FIG. 7 is diagram showing the evolution over time of the first time derivative of the difference between the electrical voltage at the ends of the coil and the reference electrical voltage.

According to a preferred embodiment, the electronic control unit 9 calculates a first time derivative dΔv/dt of the voltage difference Δv (shown in FIG. 7) and, therefore, determines the closing instant $t_5$ of the electromagnetic injector 4 based on the first time derivative dΔv/dt of the voltage difference Δv. In particular, the electronic control unit 9 determines an absolute minimum of the first time derivative dΔv/dt of the voltage difference Δv and identifies the closing instant $t_5$ of the electromagnetic injector 4 in the area of the absolute minimum of the first time derivative dΔv/dt of the voltage difference Δv (as shown in FIG. 7).

According to a possible, though non-limiting embodiment, in the closing instant $t_5$ determined as described above, a predetermined time advance is applied, which makes up for the phase delays introduced by all the filters to which the voltage v is subjected; in other words, the closing instant $t_5$ determined as described above is advanced by means of a predefined time interval in order to take into account the phase delays introduced by all the filters to which the voltage v at the ends of the coil 16 is subjected.

The electronic control unit 9 recognizes the presence of a closing of the electromagnetic injector 4 only if the voltage difference Δv, in absolute value, exceeds a first threshold, and/or recognizes the presence of a closing of the electromagnetic injector 4 only if the first time derivative dΔv/dt of the voltage difference Δv exceeds, in absolute vale, a second threshold. In other words, the electronic control unit 9 recognizes the absence of a closing of the electromagnetic injector 4 only if the voltage difference Δv, in absolute value, is below the first threshold and/or if the first time derivative dΔv/dt of the voltage difference Δv, in absolute vale, is below the second threshold. Hence, if the voltage difference Δv and/or the first time derivative dΔv/dt of the voltage difference Δv are too small (in absolute value), the electronic control unit 9 establishes that the voltage actuation time development $v_1$ is completely similar to the voltage comparison time development $v_2$ and, hence, there was no closing of the electromagnetic injector 4 (namely, a closing of the electromagnetic injector 4 is absent).

According to a possible embodiment, the test to detect the voltage comparison time development $v_2$ is carried out immediately before each fuel injection, so that a voltage comparison time development $v_2$ is used to determine the closing instant $t_5$ of the electromagnetic injector 4 of one single corresponding injection taking place immediately after. In other words, for each fuel injection, at first, a specific voltage comparison time development $v_2$ is (immediately) determined and then, right after that, the fuel injection is carried out and the specific voltage comparison time development $v_2$ is used to determine the closing instant $t_5$.

According to an alternative embodiment, the test to detect the voltage comparison time development $v_2$ is carried out every now and then, so that a voltage comparison time development $v_2$ is used to determine the closing instant $t_5$ of the electromagnetic fuel injector 4 of different injections. In other words, a voltage comparison time development $v_2$ applies to (can be used for) different injections taking place in different moments. In this case, different voltage comparison time developments $v_2$ can be stored upon variation of the pressure of the fuel in the common-rail 5. Furthermore, different voltage comparison time developments $v_2$ are detected and then statistically processed and periodically updated.

According to a possible embodiment, the voltage v is measured by the electronic control unit 9 between the two terminals 100 and 101 of the coil 16 when the first and the second voltage time developments $v_1$ and $v_2$ are detected; this solution involves a differential measurement, which is more complicated because it requires the use of two distinct voltage sensors connected to the two terminals 100 and 101 of the coil 16. Alternatively, the voltage v is measured by the electronic control unit 9 between the low-voltage terminal 101 of the coil 16 and an electric ground when the voltage time developments $v_1$ and $v_2$ are detected; this solution is simpler because it involves the use of one single voltage sensor connected to the low-voltage terminal 101 of the coil 16.

During the normal operation of the internal combustion engine 1, the electronic control unit 9 decides the values of the injection time $T_{INJ}$ for which the corresponding closing time $T_C$ must be known. It is generally unlikely that, in the short term, the engine control requires an electromagnetic injector 4 to be controlled exactly with an injection time $T_{INJ}$ for which the corresponding closing time $T_C$ must be known; as a consequence, the electronic control unit 9 "forces" the situation making sure that, in any case, (at least) one injection is carried out, which has an injection time $T_{INJ}$ for which the corresponding closing time $T_C$ must be known. In particular, the electronic control unit 9 establishes a rotation speed objective and a torque objective to be generated for an internal combustion engine 2 and, then, determines a total quantity Q of fuel to be injected based on the rotation speed objective and on the torque objective to be generated; subsequently, the electronic control unit 9 controls the electromagnetic fuel injector 4 using a first injection time $T_{INJ1}$ for which a corresponding closing time $T_C$ is to be determined and determines a first partial fuel quantity $Q_1$ which is actually injected using the first injection time $T_{INJ1}$. At this point, the electronic control unit 9 determines a second partial fuel quantity $Q_2$ equal to the difference between the total fuel quantity Q and the first partial fuel quantity $Q_1$ and determines a second injection time $T_{INJ2}$ based on the second partial fuel quantity $Q_2$ so as to exactly inject the second partial fuel quantity $Q_2$; finally, the electronic control unit 9 controls the electromagnetic fuel injector 4 using the second injection time $T_{INJ2}$.

The electronic control unit 9 chooses the first injection time $T_{INJ1}$ so that the difference between the total fuel quantity Q and the first partial fuel quantity $Q_1$ exceeds a predetermined threshold value (namely is great enough to allow the second partial fuel quantity $Q_2$ to be injected with an acceptable precision).

It should be pointed out that the method described above to determine the closing instant $t_5$ of the electromagnetic injector 4 applies in any operating condition of the electromagnetic injector 4, i.e. both when the electromagnetic injector 4 operates in the ballistic area B, in which, in the end instant $t_3$ of the injection, the plunger 23 still has not reached the complete open position of the injection valve 15, and when the electromagnetic injector 4 operates in the linear area C, in which, in the end instant $t_3$ of the injection, the plunger 23 has reached the complete open position of the injection valve 15. However, knowing the closing instant $t_5$ of the electromagnetic injector 4 is particularly useful when the electromagnetic injector 4 operates in the ballistic area B, in which the injection feature of the electromagnetic injector 4 is strongly non-linear and dispersed, whereas it generally is not very useful when the electromagnetic injector 4 operates in the linear area C, in which the injection feature of the electromagnetic injector 4 is linear and not very dispersed.

Hereinafter is a description of the procedure used by the electronic control unit 9 to determine the opening time $T_O$ of the electromagnetic fuel injector 4.

The electronic control unit 9 controls the electromagnetic fuel injector 4 using a series of progressively increasing energization times $T_{INJ}$ of the electromagnetic actuator 14 and determines, for each control of the electromagnetic injector 4, the presence or the absence of a closing of the injection valve 15 (i.e. whether the injection valve 15 actually opened or did not open) according to the procedure described above; finally, the electronic control unit 9 identifies the opening time $T_O$ equal to an intermediate value between the last energization time $T_{INJ}$ of the electromagnetic actuator 14 for which the absence of a closing of the injection valve 15 was determined and the first energization time $T_{INJ}$ of the electromagnetic actuator 14 for which the presence of a closing of the injection valve 15 was determined.

According to a preferred embodiment, the control unit 9 establishes an expected value of the opening time $T_O$ (for example, equal to a nominal value or equal to the last, previously estimated value) and centres the series of progressively increasing energization times $T_{INJ}$ of the electromagnetic actuator 14 on the expected value of the opening time $T_O$.

According to a preferred embodiment, the electronic control unit 9 establishes a time resolution in determining the presence or the absence of a closing of the injection valve 15 and, then, increases the energization times $T_{INJ}$ of the electromagnetic actuator 14 of the series of progressively increasing energization times $T_{INJ}$ of the electromagnetic actuator 14 with an increase which is equal to the time resolution in determining the presence or the absence of a closing of the injection valve 15. The resolution in the ability, in the execution of a measurement, to detect small variations of the physical quantity being examined (namely, the ability to detect whether an opening of the injection valve 15 took place or did not take place).

According to a preferred embodiment, the presence or the absence of a closing of the injection valve 15 (i.e. whether the injection valve 15 actually opened or did not open) during the control of an electromagnetic injector 4 are determined as described above (namely, by analysing the voltage difference $\Delta v$ and/or the first time derivative $d\Delta v/dt$ of the voltage difference $\Delta v$); according to a different embodiment, the presence or the absence of a closing of the injection valve 15 (namely, whether the injection valve 15 actually opened or did not open) during the control of an electromagnetic injector 4 can be determined with different procedures from the one described above.

The embodiments described herein can be combined with one another, without for this reason going beyond the scope of protection of the invention.

The method described above to determine a closing instant of an electromagnetic fuel injector 4 has numerous advantages.

First of all, the method described above to determine a closing instant of an electromagnetic fuel injector 4 allows the actual closing instant of an electromagnetic injector 4 to be identified with a great precision. This result is obtained thanks to the fact that the "behaviour" of an electromagnetic injector 4 in the moment of the closing of the injection valve 15 (namely, the voltage actuation time development $v_1$) is compared with "itself", i.e. with the "behaviour" of the same identical electromagnetic injector 4 in the same identical conditions in the absence of an opening (and, hence, of a closing) of the injection valve 15 (namely, with the voltage comparison time development $v_2$); in this way, the effect of all the unforeseeable variables (building tolerances, ageing of the the components, pressure of the fuel, work temperature . . . ) that determine an (even significant) dispersion in the operating mode is "neutralized". When the voltage comparison time development $v_2$ is acquired a few milliseconds before the acquisition of the voltage actuation time development $v_1$, it is evident that the acquisitions take place not only on the same component (namely, the same electromagnetic injector 4), but also under the same identical surrounding conditions (fuel pressure, work temperature . . . ); by so doing, the comparison between the voltage actuation time development $v_1$ and the voltage comparison time development $v_2$ is not affected in any way by unforeseeable variables and allows the closing instant $t_5$ of the injection valve 15 to be determined with a great precision.

As already mentioned above, knowing the actual closing instant of an electromagnetic injector 4 is very important when the injector is used to inject small quantity of fuel because, by so doing, the actual quantity of fuel that was injected by the injector with every injection can be estimated with a great precision. In this way, an electromagnetic fuel injector 4 can also be used in the ballistic area to inject very small quantities of fuel (about 1 milligram), ensuring at the same time an adequate precision of the injection. It should be pointed out that the precision in the injection of very small quantities of fuel is not reached by reducing the dispersion of the features of the injector (which is an extremely complicated and expensive operation), but it is reached thanks to the possibility of immediately correcting the differences from the ideal condition, using the fact of knowing the actual quantity of fuel that was injected by the injector with each injection (the actual quantity of fuel that was injected is estimated using the fact of knowing of the actual closing time).

Furthermore, the method described above to determine a closing instant of an electromagnetic fuel injector 4 is simple and economic to be implemented even in an existing electronic control unit 9, because it does not require additional hardware to be added to the hardware already normally present in fuel injection systems, does not need a significant calculation ability and does not involve a large memory space.

The method described above to determine the opening time $T_O$ of an electromagnetic fuel injector 4 has numerous advantages.

First of all, the method described above to determine the opening time $T_O$ allows the actual opening time $T_O$ of an electromagnetic injector 4 to be identified with a good precision. Knowing the actual opening time TO of an electromagnetic injector 4 is important because the opening time TO establishes, in the law of injection, the boundary between the initial area A of failed opening and the ballistic operating area B: indeed, if the injection time $T_{INJ}$ is smaller than the opening time $T_O$, the injection valve 15 does not open and, hence, we are in the initial area A of failed opening, whereas, if the injection time $T_{INJ}$ is greater than the opening time $T_O$, the injection valve 15 opens and, hence, we are in the ballistic operating area B (or, if the injection time $T_{INJ}$ is long enough, we are in the linear area C). Therefore, knowing the actual opening time $T_O$ of an electromagnetic injector 4 leads to better knowing of the corresponding law of injection and, hence, allows the electromagnetic injector 4 to be controlled with a greater precision.

Furthermore, the method described above to determine the opening time $T_O$ of an electromagnetic fuel injector 4 is simple and economic to be implemented even in an existing electronic control unit 9, because it does not require additional hardware to be added to the hardware already normally present in fuel injection systems, does not need a significant calculation ability and does not involve a large memory space.

LIST OF THE REFERENCE NUMBERS OF THE FIGURES

1 injection system
2 engine
3 cylinders
4 injectors
5 common-rail
6 high-pressure pump
7 low-pressure pump
8 tank
9 electronic control unit
10 longitudinal axis of 4
11 injection nozzle
12 support body
13 feeding channel
14 electromagnetic actuator
15 injection valve
16 coil
17 toroidal casing
18 fixed magnetic pole
19 movable armature
20 magnetic armature
21 annular seat
22 magnetic washer
23 plunger
24 valve seat
25 central hole
26 closing spring
27 striker body
28 calculation block
29 calculation block
30 calculation block
31 subtractor block
32 calculation block
100 terminal
101 terminal
$t_1$ time instant
$t_2$ time instant
$t_3$ time instant
$t_4$ time instant
$t_5$ time instant
A initial area
B ballistic area
C linear area
Q fuel quantity
$T_{INJ}$ injection time
$T_{HYD}$ hydraulic time
$T_C$ closing time
$T_Z$ zeroing time
$T_F$ flying time
$T_O$ opening time
$v_1$ first voltage time development
$v_2$ second voltage time development
$\Delta v$ voltage difference

The invention claimed is:

1. A method to determine an opening time ($T_O$) of an electromagnetic fuel injector (4), which comprises a movable plunger (23) moving between a closing position and an opening position to close and open an injection valve (15), and an electromagnetic actuator (14), which is provided with a coil (16) and is designed to move the plunger (23) between the closing position and the opening position; the method comprises the steps of:

controlling the electromagnetic fuel injector (4) using a series of progressively increasing energization times ($T_{INJ}$) of the electromagnetic actuator (14);

determining, for each control of the electromagnetic injector (4), the presence or the absence of a closing of the injection valve (15); and identifying the opening time ($T_O$) equal to an intermediate value between the last energization time ($T_{INJ}$) of the electromagnetic actuator (14) for which the absence of a closing of the injection valve (15) was determined and the first energization time ($T_{INJ}$) of the electromagnetic actuator (14) for which the presence of a closing of the injection valve (15) was determined;

wherein the step of determining, for each control of the electromagnetic injector (4), the presence or the absence of a closing of the injection valve (15) comprises the further steps of:

applying, in a beginning instant ($t_1$) of a test, a positive voltage (v) to the coil (16) of the electromagnetic actuator (14) so as to cause a test electric current (i) to circulate through the coil (16), said test electric current (i) certainly not determining the opening of the injection valve (15);

applying, in an end instant (t3) of the test, a negative voltage (v) to the coil (16) of the electromagnetic actuator (14) so as to cancel the test electric current (i);

detecting a voltage comparison time development (v2) at at least one end of the coil (16) of the electromagnetic actuator (14) after the cancellation of the test electric current (i);

applying, in a beginning instant ($t_1$) of an energization of the electromagnetic actuator (14), a positive voltage (v) to the coil (16) of the electromagnetic actuator (14) so as to cause an actuation electric current (i) to circulate through the coil (16), said actuation electric current (i) could maybe determine the opening of the injection valve (15);

applying, in an end instant ($t_2$) of the energization of the electromagnetic actuator (14), a negative voltage (v) to the coil (16) of the electromagnetic actuator (14) so as to cancel the actuation electric current (i);

detecting a voltage actuation time development ($v_1$) at at least one end of the coil (16) of the electromagnetic actuator (14) after the cancellation of the actuation electric current (i);

calculating a voltage difference (Δv) between the voltage actuation time development ($v_1$) and the voltage comparison time development ($v_2$);

calculating a first time derivative (dΔv/dt) of the voltage difference (Δv);

calculating a maximum value of the first time derivative (dΔv/dt) of the voltage difference (Δv);

identifying the presence of a closing of the electromagnetic injector (4) only if the maximum value of the first time derivative (dΔv/dt) of the voltage difference (Δv) exceeds, in absolute value, a first threshold; and identifying the absence of a closing of the electromagnetic injector (4) only if the maximum value of the first time derivative (dΔv/dt) of the voltage difference (Δv) is, in absolute value, below the first threshold.

2. The method according to claim 1 and comprising the further steps of:

establishing an expected value of the opening time ($T_O$); and centering the series of progressively increasing energization times ($T_{INJ}$) of the electromagnetic actuator (14) on the expected value of the opening time ($T_O$).

3. The method according to claim 1 and comprising the further steps of establishing a time resolution in determining the presence or the absence of a closing of the injection valve (15); and increasing the energization times ($T_{INJ}$) of the electromagnetic actuator (14) of the series of progressively increasing energization times ($T_{INJ}$) of the electromagnetic actuator (14) with an increase equal to the time resolution in determining the presence or the absence of a closing of the injection valve (15).

4. The method according to claim 1 and comprising the further step of synchronizing the voltage actuation time development ($v_1$) with the voltage comparison time development ($v_2$) by aligning, in a time-wise manner, a first instant ($t_4$) in which the actuation electric current (i) is cancelled with a second instant ($t_4$) in which the test electric current (i) is cancelled.

5. The method according to claim 1 and comprising the further steps of:

calculating a maximum value of the voltage difference (Δv);

identifying the presence of a closing of the electromagnetic injector (4) only if the maximum value of the voltage difference (Δv) exceeds, in absolute value, a second threshold; and identifying the absence of a closing of the electromagnetic injector (4) if the maximum value of the voltage difference (Δv) is, in absolute value, below the second threshold.

6. The method according to claim 1 and comprising the further step of applying a low-pass filter, in particular a sliding-window filter, to the voltage difference (Δv).

7. The method according to claim 1 and comprising the further step of applying an anti-aliasing filter to the voltage (v) when the voltage time developments ($v_1$, $v_2$) are detected.

8. The method according to claim 1, wherein:

the coil (16) of the electromagnetic actuator (14) has a high-voltage terminal (100) and a low-voltage terminal (101); and the voltage (v) is measured between the two terminals (100, 101) of the coil (16) when the first and the second voltage time developments ($v_2$) are detected.

9. The method according to claim 1, wherein:

the coil (16) of the electromagnetic actuator (14) has a high-voltage terminal (100) and a low-voltage terminal (101); and the voltage (v) is measured between the two low-voltage terminal (101) of the coil (16) and an electric ground when the first and the second voltage time developments ($v_1$, $v_2$) are detected.

* * * * *